US007347790B2

(12) United States Patent
Zimmerman

(10) Patent No.: US 7,347,790 B2
(45) Date of Patent: Mar. 25, 2008

(54) GOLF SWING TRAINING DEVICE

(76) Inventor: Keenan Zimmerman, 608 Meadow Rd., Polson, MT (US) 59860

( * ) Notice: Subject to any disclaimer, the term of this patent is extended or adjusted under 35 U.S.C. 154(b) by 20 days.

(21) Appl. No.: 11/410,787

(22) Filed: Apr. 25, 2006

(65) Prior Publication Data

US 2007/0042830 A1 Feb. 22, 2007

Related U.S. Application Data

(60) Provisional application No. 60/708,996, filed on Aug. 17, 2005.

(51) Int. Cl.
*A63B 69/36* (2006.01)

(52) U.S. Cl. ..... 473/235; 473/280; 273/DIG. 30

(58) Field of Classification Search ..... 473/235, 473/280; 273/348.4, DIG. 30
See application file for complete search history.

(56) References Cited

U.S. PATENT DOCUMENTS 2,264,802 A * 12/1941 Kohl ..... 473/280
3,401,941 A * 9/1968 Hesidence ..... 473/235
3,721,447 A * 3/1973 Louderback ..... 473/235
3,870,316 A * 3/1975 DeBrocke ..... 473/235
4,149,726 A * 4/1979 Tredway, Sr. ..... 473/235
4,826,173 A * 5/1989 Brown ..... 473/235
5,026,064 A * 6/1991 Novosel ..... 473/235
5,082,284 A * 1/1992 Reed ..... 473/235
5,181,723 A * 1/1993 Brown ..... 473/235
5,702,309 A * 12/1997 Lee ..... 473/235
5,782,701 A * 7/1998 O'Bryan ..... 473/235
2003/0176228 A1 * 9/2003 Santa Cruz et al. ..... 473/235

* cited by examiner

*Primary Examiner*—Sebastiano Passaniti
(74) *Attorney, Agent, or Firm*—Adam H. Jacobs

(57) ABSTRACT

A golf swing training device including a training ball constructed of a compactable, resiliently deformable foam material, the training ball including at least two generally flat club impact surfaces each formed along a chord plane angled between approximately five degrees and twenty-five degrees from vertical and spaced from the center of the training ball with each of the at least two generally flat faces being substantially covered with a releasable adhesive material. A club face releasable adhesive material is removably mounted on and substantially covers the ball striking face of a golf club and the releasable adhesive materials on the training ball and the ball striking face cooperatively operate to releasably engage with one another upon impact of the ball striking face with the training ball thereby generally causing the training ball to be releasably retained on the ball striking face at the location of impact.

7 Claims, 3 Drawing Sheets

GOLF SWING TRAINING DEVICE

CROSS-REFERENCE TO RELATED PROVISIONAL PATENT

This application claims priority based on a provisional patent, specifically on the Provisional Patent Application Ser. No. 60/708,996 filed Aug. 17, 2005.

BACKGROUND OF THE INVENTION

1. Technical Field

The present invention relates to golf swing training devices and, more particularly, to a golf swing training device which includes a ball constructed of a compactable, resilient foam material, the ball including at least one generally flat surface formed along a chord plane angled approximately ten degrees from perpendicular, the generally flat face being covered in either the hook or the loop section of a standard hook and loop fabric, and the opposite part of the hook and loop fabric being affixed to the ball striking face of a selected golf club such that impact of the hook fabric covered face of the golf club with the generally flat face of the ball causes the ball to be releasably retained on the face of the club, thus showing the location of impact between the golf club face and the ball.

2. Description of the Prior Art

Golf can be both a supremely enjoyable and a supremely frustrating game, particularly for those persons who have neither the time nor the inclination to play golf often. In order to gain golf skills, thereby gaining enjoyment of the game, it is clear that one must practice his or her swing in order to gain consistency and repeatability of the swing. Traditionally, however, this could only be done on driving ranges or in other locations where the player can hit numerous golf balls with various clubs and not be concerned about where the struck golf balls wind up. Going to driving ranges, however, can be both expensive and time consuming, and therefore there is a need for swing training devices which do not require the actual hitting of golf balls to increase consistency in the player's swing.

There are many different types of swing training devices which are currently found in the art, such as clubs with hinges built into the shafts that will "break down" when the player makes an incorrect swing and devices which include large circular frames which provide visual confirmation of the golf swing plane to encourage development of a repeatable swing. These devices encourage development of the proper club swing and proper physical positions during the swing. However, very few, if any, of the currently available swing training devices address the other significant problem with most golfers' swings, and that is the location of the impact of the club with the golf ball on the club face. A golfer may have the prettiest swing ever seen, but if he or she cannot consistently have the club face impact the ball in the center of the club face, it is highly unlikely that he or she will ever develop into a good golfer. There is therefore a need for a swing training device which will permit the golfer to develop consistency in the location of the impact between the club face and the golf ball.

One of the other significant disadvantages with the majority of golf swing training devices currently available is that they can only be used in environmental conditions which are also conducive for actually playing golf. Specifically, the vast majority of swing training devices cannot be used indoors or in inclement weather and therefore there is a need for a golf swing training device which may be safely used indoors to provide year-round swing training and provide at least some of the thrill of actually hitting a golf ball even when weather and/or circumstances do not permit the actual playing of a round of golf.

Several golf swing training devices have been proposed in the prior art, including Louderback, U.S. Pat. No. 3,721,447, and Hesidence, U.S. Pat. No. 3,401,941, each of which disclose training golf balls adapted to be retained on the club head face after impact. Each of the prior art devices, however, include inherent disadvantages which do not provide accurate or beneficial swing training results. Specifically, Hesidence discloses a training ball having an additional outwardly-extending plastic plate mounted on the training ball. Clearly, were the club head face to impact the plate at an offset angle, the force of the impact would be likely to break or damage the outwardly-extending plate, and successive impacts would almost certainly cause pieces of the plate to fly off of the plate, thus substantially increasing the chance for impact injuries resulting from flying pieces of the broken plate. Louderback, on the other hand, includes no such plate but instead utilizes a standard round ball which, when impacted by the golf club face, allegedly will be retained on the golf club face due to the interaction of the hook and loop fasteners between the golf club face and the practice ball. However, in actual use, it has been found that the practice ball of Louderback does not include sufficient club face impact surface area to properly retain the practice ball on the golf club face and therefore the practice ball will often fly off of the golf club face after impact which can result in the practice ball flying off and impacting unintentional targets thus causing damage to other objects or people. There is therefore a need for an improved golf swing training device which utilizes a practice ball and which will retain the practice ball on the golf club face after impact almost every time the golf club face properly impacts the practice ball.

Therefore, an object of the present invention is to provide a golf swing training device which will assist a golfer in developing an improved and more consistent swing.

Another object of the present invention is to provide a golf swing training device which includes a training ball having two generally flat chord plane faces each extending approximately ten degrees from vertical generally perpendicular with the diameter of the training ball, with each of the generally flat faces being covered in a hook and loop material which, when impacted by a club head having a similar hook and loop fastener material mounted thereon, will result in the training ball sticking to the face of the golf club post-impact.

Another object of the present invention is to provide a golf swing training device which will immediately display for the user the precise location at which the impact between the club head face and the training ball occurred due to the training ball being retained on the club head face.

Another object of the present invention is to provide a golf swing training device which is usable indoors due to the relatively light weight of the training ball and the fact that a very high percentage of club head face to training ball impacts result in the training ball being retained on the club head face.

Another object of the present invention is to provide a golf swing training device which can be used with the golfer's normal golf clubs, thus permitting the golfer to hone his or her swing with the actual clubs he or she will be using on the golf course.

Finally, an object of the present invention is to provide a golf swing training device which is relatively simple and economical to manufacture and is safe, effective and efficient in use.

SUMMARY OF THE INVENTION

The present invention provides a golf swing training device including a training ball constructed of a compactable, resiliently deformable foam material, the training ball including at least two generally flat club impact surfaces each formed along a chord plane angled between approximately five degrees and twenty-five degrees from vertical and spaced from the center of the training ball with each of the at least two generally flat faces being substantially covered with a releasable adhesive material such as a hook and loop fastener fabric. A club face releasable adhesive material such as a hook and loop fastener fabric is removably mounted on and substantially covers the ball striking face of a selected golf club and the releasable adhesive material on each of the at least two generally flat faces and the club face releasable adhesive material are cooperatively operative to releasably engage with one another upon impact of the ball striking face of the selected golf club with one of the at least two generally flat faces of the training ball thereby generally causing the training ball to be releasably retained on the ball striking face of the selected golf club at the location of impact between the ball striking face of the selected golf club and the training ball.

As thus described, the golf swing training device of the present invention provides numerous advantages over those various types of golf swing training devices found in the prior art. For example, because the present invention can be used with the actual clubs owned by the golfer, he or she may develop their swing using the same clubs which they will be using on the golf course itself. This will certainly enhance repeatability and reliability of the golfer's swing, as he or she will not be constantly switching clubs between the training club and the regular clubs in order to use the present invention. Also, because the present invention may be used indoors in a safe and effective manner, the golfer may practice his or her swing year-round, and, as golf is becoming more and more popular even in areas having a relatively short golf season, the advantages provided by permitting year-round practice are incalculable. Finally, because the training ball of the present invention includes two angled flat faces which provide the position for the club face to impact the training ball, the usable lifespan of the training ball is effectively doubled, as each face is designed to receive impacts thereon, as opposed to those devices found in the prior art which include only a single impact surface. The golf swing training device of the present invention thus provides a substantial improvement over those training devices found in the prior art.

DESCRIPTION OF THE PREFERRED EMBODIMENT

The golf swing training device 10 of the present invention is shown best in FIGS. 1-5 as including a training ball 12 which, in the preferred embodiment, would be approximately one and eleven sixteenths inches in diameter, the same as a standard golf ball, and would preferably be constructed of a memory-type foam material which is impact-absorbing, yet is resilient to return to its original shape after impact. It is preferred that the training ball 12 be generally spherical, yet include two generally flat faces 14 and 16 which are formed by removing a portion of the training ball 12 along a chord plane extending approximately ten degrees from perpendicular with the diameter of training ball 12, as shown best in FIGS. 1 and 2. In the preferred embodiment, the first and second flat faces 14 and 16 on training ball 12 would be angled such that the first and second flat faces 14 and 16 are vertically divergent from one another when the training ball 12 is placed in the hitting position shown in FIG. 1 on the appropriate golf tee device 40.

Figure 1:
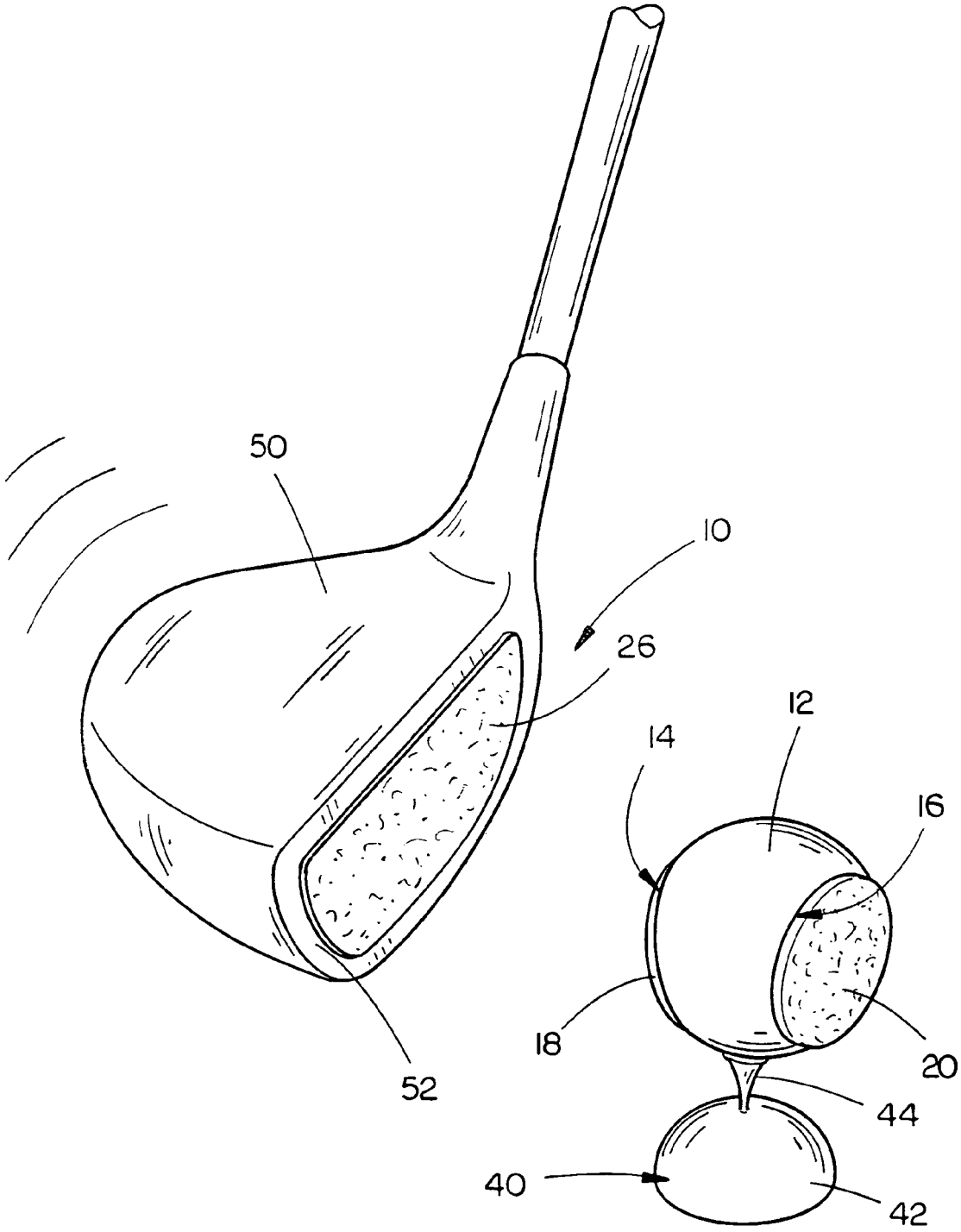
FIG. 1 is a perspective view of the golf swing training device of the present invention.
Figure 3:
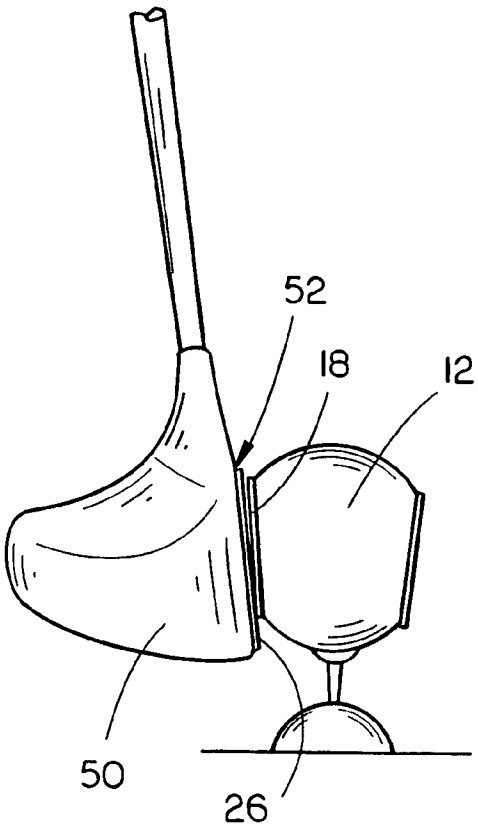
FIG. 3 is a side elevational view of the present invention at impact showing a proper hit of the golf club on the training ball.
Figure 2:
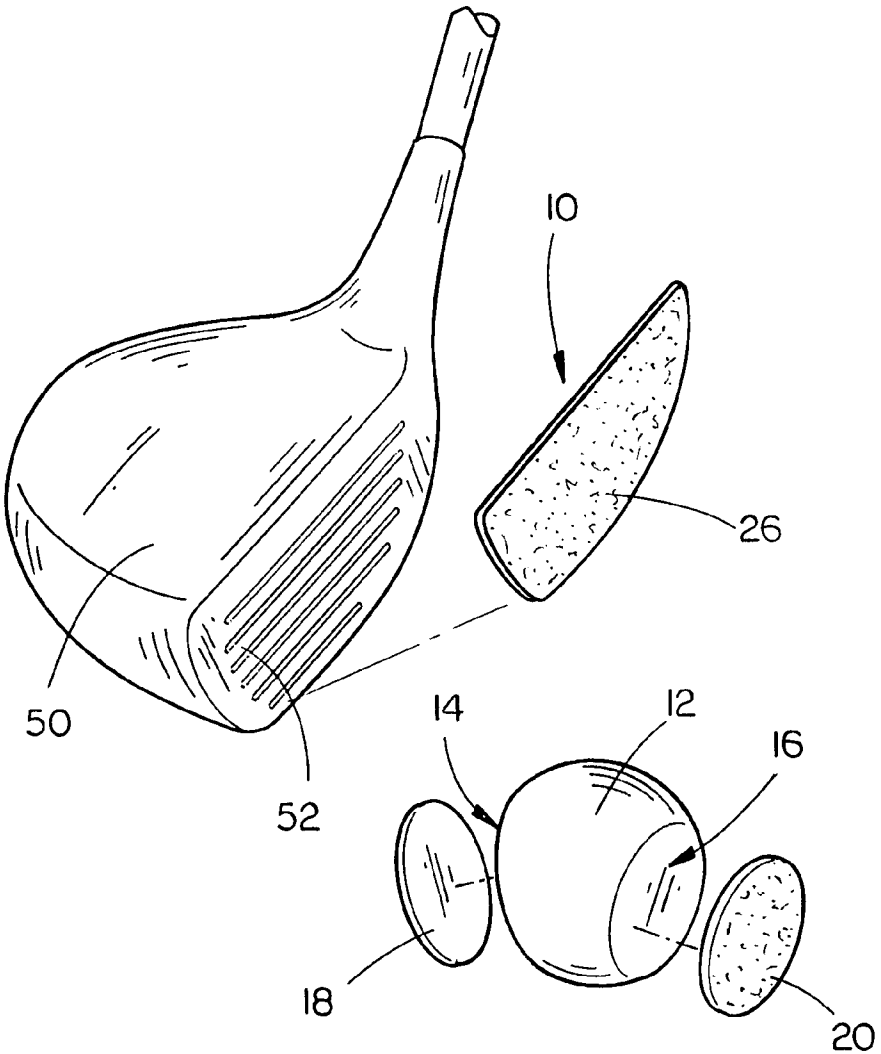
FIG. 2 is a detailed exploded perspective view of the present invention showing the elements of the present invention.
Figure 5:
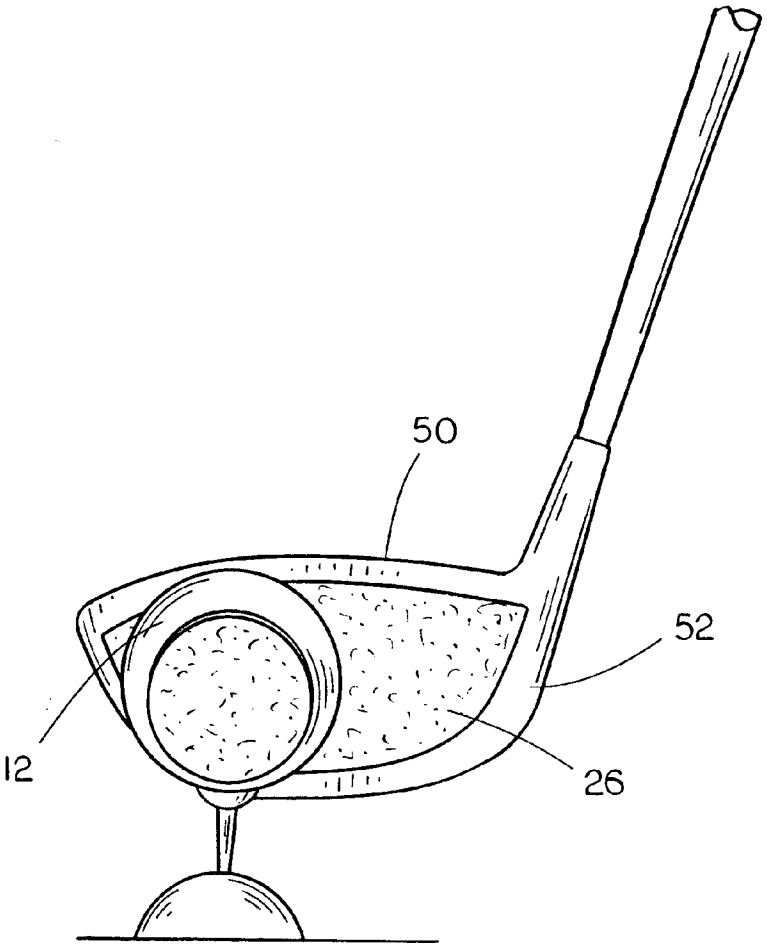
FIGS. 4 and 5 are, respectively, side and front elevational views of the present invention showing various mishits and how the present invention provides visual confirmation of the mishit location.
Figure 4:
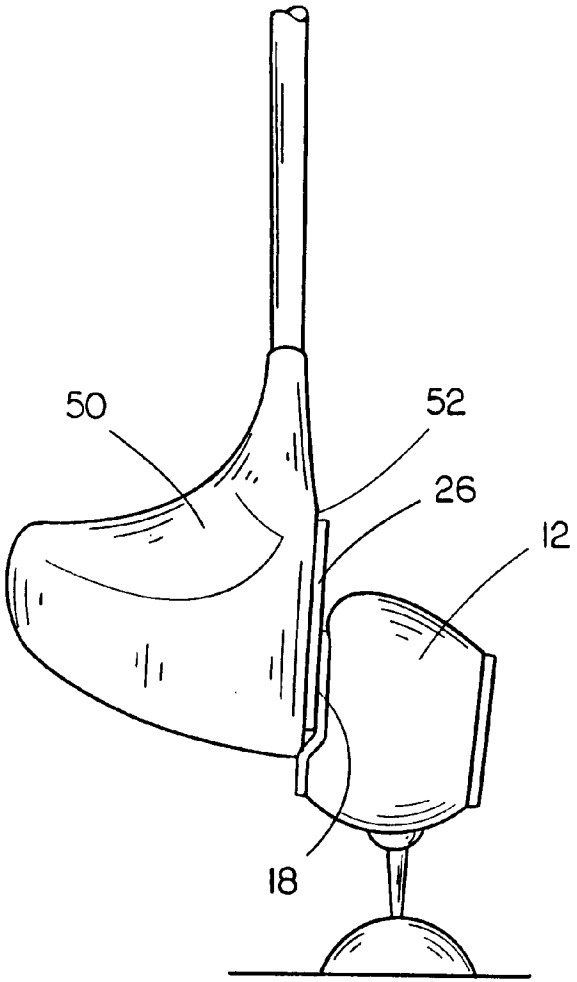

Mounted on each of the first and second flat faces 14 and 16 are slightly oval sections of hook and loop fabric, specifically a first oval section 18 of the loop panel of the hook and loop fabric and a second oval section 20 of the loop panel of the hook and loop fabric mounted on the second flat face 16, as shown best in FIGS. 1 and 2. It is preferred that the first and second loop panels 18 and 20 be affixed to the first and second flat faces 14 and 16 by any appropriate adhesive substance, although it has been found that various types of fabric glues will work best to secure the panels to the flat faces. The exact nature of the adhesive material is not critical to the present invention, however, so long as the first and second loop panels 18 and 20 are securely affixed to the first and second flat faces 14 and 16 of training ball 12.

To complete the functional elements of the golf swing training device 10 of the present invention, the golf club face-shaped hook panel 26 of the hook and loop fabric must be securely yet releasably mounted on the ball striking face 52 of the selected golf club 50, as shown best in FIGS. 1 and 2. As can be seen, it is preferred that the hook panel 26 have dimensions approximately equal to the ball striking face 52 of the golf club 50, although some variation from the precise shape of the ball striking face 52 will not significantly impair functionality of the golf swing training device 10 of the present invention. It is important, however, that the hook panel 26 be securely mounted on the ball striking face 52 in order to ensure that the hook panel 26 does not accidentally dislodge from the ball striking face 52 during use of the golf swing training device 10 of the present invention. There are numerous types of adhesive materials, including two-sided tape, adhesive gels and other such releasable securement materials which may be used with the present invention. The important considerations, however, are that the hook panel 26 not be able to accidentally dislodge from the ball striking face 52 and further that the hook panel 26 may be intentionally removed from the ball striking face 52 without leaving significant residue on the ball striking face 52 to permit use of the golf club 50 in regular golfing activities.

Once the hook panel 26 has been mounted on the selected golf club 50, the golf swing training device 10 of the present invention is ready for use. The user would first place the training ball 12 on the golf tee device 40 which, in the preferred embodiment, would include a hemispherical ground-engaging base 42 and an upwardly-extending ball support tee 44 which functions in the same manner as a standard golf tee, and may in fact be a standard golf tee, but does not require insertion of the tee into a ground surface. The training ball 12 would then be placed on the ball support tee 44 with at least one of the first and second flat faces 14 and 16 facing rearwards and downwards, as shown best in FIGS. 1 and 3, towards the line of travel of the golf club 50. The user of the present invention would then assume his or her golf swing stance and grip the golf club 50 in preparation for swinging the golf club 50. The intent of the user should be to strike the training ball 12 with the golf club 50 such that the ball striking face 52 and specifically hook panel 26 on ball striking face 52 engages the first loop panel 18 on first flat face 14 of training ball 12, as shown best in FIG. 3. As the golf swing is commenced, the user would swing the golf club 50 in his or her regular manner, and as the golf club 50 begins to engage the training ball 12, the memory-type foam construction material of the training ball 12 deforms as it absorbs a significant amount of the force of the impact of the golf club 50 with the training ball 12. The absorption and dispersion of the majority of the force of the impact permits the first loop panel 18 on first flat face 14 to engage hook panel 26 in standard hook and loop fabric fashion to releasably retain the first loop panel 18 on hook panel 26 thereby retaining training ball 12 on the ball striking face 52 of golf club 50. The angle of the first flat face 14 is thus seen to be important as the majority of ball striking faces 52 on drivers have lofts of between eight degrees and twelve degrees (8° and 12°) so that the ball striking face 52 and first flat face 14 of training ball 12 are generally parallel with one another at impact, thus affording that a maximum surface area of hook panel 26 and first loop panel 18 interact to secure the training ball 12 on the golf club 50.

As the swing of the golf club 50 continues through the impact zone, the training ball 12 is retained on the ball striking face 52 of golf club 50 such that, when the swing is completed, the user of the golf swing training device 10 of the present invention may see exactly where he or she caused the ball striking face 52 of golf club 50 to impact the training ball 12. The ideal position for impact between the training ball 12 and ball striking face 52 would of course be at the center of the ball striking face 52, as shown best in FIG. 3, and it is towards this ideal that the user of the present invention will strive. Of course, for the majority of players, absolute consistency in ball striking is the goal, but is certainly not an easily obtainable goal. In fact, the majority of players will likely have mishits such as the ones shown in FIGS. 4 and 5, with the mishit in FIG. 4 being a traditional "topping" of the training ball 12 and the mishit of FIG. 5 being a hitting of the training ball 12 off the toe of the club, both of which represent common ball striking mistakes made by amateurs and less-practiced golfers. The benefit of the present invention is that the user of the present invention may quickly and easily visually identify the precise location at which contact between the ball striking face 52 of the golf club 50 and the training ball 12 took place as the training ball 12 is retained on the ball striking face 52 in the exact location at which impact took place. By repeating his or her swing numerous times, the golfer will eventually find his or her "groove" and will develop a repeatable and precise swing which causes the ball striking face 52 of golf club 50 to strike the training ball 12 in the center of the ball striking face 52 more and more often.

One of the main benefits of the golf swing training device 10 of the present invention is that the user of the present invention may affix the hook panel 26 to the ball striking face 52 of any selected golf club 50, and thus may practice his or her swing with his or her own club to develop a repeatable and accurate swing with the actual club which will be used in the golfing situation. Furthermore, because of the construction material used in connection with the training ball 12, even if the user of the golf swing training device 10 completely mishits the training ball 12 and thus does not cause the training ball 12 to properly adhere to the ball striking face 52, the training ball 12 will not cause any significant amount of damage even if the present invention is being used indoors. This is because the training ball 12 is heavy enough to allow the hook and loop fabric material to properly engage yet is light enough to keep the amount of kinetic energy caused by the swinging of the golf club 50 and impact of the ball striking face 52 with the training ball 12 quite low and well within a safe range. Finally, because of the nature of the hook and loop fabric used in connection with the present invention, once the user of the invention has swung the golf club 50 to create the impact between the ball striking face 52 and training ball 12, he or she may quickly and easily remove the training ball 12 from the ball striking face 52 by disengaging the first loop panel 18 or second loop panel 20 from the hoop panel 26, then replace the training ball 12 on the golf tee device 40 and repeat the swing training process.

It is to be understood that numerous additions, modifications and substitutions may be made to the golf swing training device 10 of the present invention which fall within the intended broad scope of the above description. For example, although it is preferred that the training ball 12 be constructed as approximating the size and shape of a golf ball, it is not strictly necessary that the training ball have that same size and shape. Furthermore, although it is preferred that the training ball 12 be constructed of a memory foam-type material, numerous other impact-absorbing and light-weight construction materials may be substituted so long as the functional characteristics of the training ball 12 are neither degraded nor destroyed. Also, the precise nature of the golf tee device 40 may be modified or changed, and in fact, as discussed previously, may be designed to work with standard tees, and such modifications and substitutions should be understood to be a part of this disclosure and are acceptable so long as the functional features of the golf tee device 40 are maintained. Finally, the various adhesive materials described herein may be modified or changed so long as the functional characteristics of the adhesive materials are maintained, specifically securing the hook panel 26 on the ball striking face 52 and securing the first and second loop panels 18 and 20 on the first and second flat faces 14 and 16 of training ball 12.

There has therefore been shown and described a golf swing training device 10 which accomplishes at least all of its intended purposes.

I claim:

1. A golf swing training device comprising:

a training ball constructed of a compactable, resiliently deformable foam material, said training ball including at least two generally flat planar club impact surfaces each formed along a chord plane in said training ball and angled between approximately five degrees and twenty-five degrees from vertical and spaced from the center of said training ball;

each of said at least two generally flat planar faces being substantially covered with a releasable adhesive means, each of said at least two generally flat planar faces being upwardly outwardly divergent from one another;

club face releasable adhesive means removably mounted on and substantially covering the ball striking face of a selected golf club; and said releasable adhesive means on each of said at least two generally flat planar faces and said club face releasable adhesive means cooperatively operative to releasably engage with one another upon impact of the ball striking face of the selected golf club with one of said at least two generally flat planar faces of said training ball thereby generally causing said training ball to be releasably retained on the ball striking face of the selected golf club at the location of impact between the ball striking face of the selected golf club and said training ball.

2. The golf swing training device of claim 1 wherein said training ball is constructed of a memory foam material.

3. The golf swing training device of claim 1 wherein said at least two generally flat planar club impact surfaces comprise two generally flat planar club impact surfaces formed on opposite sides of said training ball along a chord plane angled at approximately ten degrees from vertical.

4. The golf swing training device of claim 1 wherein said releasable adhesive means on each of said at least two generally flat planar faces comprises one of a hook panel and a loop panel of a hook and loop fabric material.

5. The golf swing training device of claim 4 wherein said club face releasable adhesive means comprises the other one of said hook panel and said loop panel of said hook and loop fabric material adapted to be removably mounted on and substantially cover the ball striking face of a selected golf club.

6. A golf swing training device comprising:

a training ball constructed of a compactable, resilient memory foam material, said training ball including two generally flat planar club impact surfaces each formed along a chord plane in said training ball and angled between approximately five degrees and fifteen degrees from vertical, each of said two generally flat planar faces being upwardly outwardly divergent from one another and spaced from the center of said training ball;

each of said two generally flat planar faces being substantially covered with one of a hook panel and a loop panel of a hook and loop fabric material;

the other one of said hook panel and said loop panel of said hook and loop fabric material adapted to be removably mounted on and substantially cover the ball striking face of a selected golf club; and said hook panel and said loop panel of said hook and loop fabric material operative to releasably engage with one another upon impact of the ball striking face of the selected golf club with one of said two generally flat planar faces of said training ball thereby generally causing said training ball to be releasably retained on the ball striking face of the selected golf club at the location of impact between the ball striking face of the selected golf club and said training ball.

7. The golf swing training device of claim 6 wherein said two generally flat planar club impact surfaces are formed on opposite sides of said training ball along a chord plane angled at approximately ten degrees from vertical.

* * * * *